US011292264B2

(12) United States Patent
Anderson et al.

(10) Patent No.: US 11,292,264 B2
(45) Date of Patent: Apr. 5, 2022

(54) PRINT MATERIAL LEVEL SENSING

(71) Applicant: Hewlett-Packard Development Company, L.P., Spring, TX (US)

(72) Inventors: Daryl E Anderson, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,042

(22) PCT Filed: Apr. 5, 2019

(86) PCT No.: PCT/US2019/026107

§ 371 (c)(1),
(2) Date: Oct. 8, 2020

(87) PCT Pub. No.: WO2020/204946

PCT Pub. Date: Oct. 8, 2020

(65) Prior Publication Data

US 2022/0048296 A1 Feb. 17, 2022

(51) Int. Cl.
*B41J 2/175* (2006.01)

(52) U.S. Cl.
CPC .. *B41J 2/17566* (2013.01); *B41J 2002/17579* (2013.01)

(58) Field of Classification Search
CPC ..... B41J 2/17566; B41J 2002/17579
See application file for complete search history.

(56) References Cited

U.S. PATENT DOCUMENTS

| | | | | |
|---|---|---|---|---|
| 4,609,924 | A | 9/1986 | De Young | |
| 8,562,091 | B2 | 10/2013 | Sabanovic et al. | |
| 2018/0100753 | A1* | 4/2018 | Cumbie | G01F 23/247 |
| 2019/0162576 | A1* | 5/2019 | Chen | B41J 2/17566 |

FOREIGN PATENT DOCUMENTS

| | | | |
|---|---|---|---|
| WO | WO-2017189010 | A1 | 11/2017 |
| WO | WO-2017189011 | A1 | 11/2017 |
| WO | WO-2017189013 | A1 | 11/2017 |
| WO | WO-2018013078 | A1 | 1/2018 |

* cited by examiner

*Primary Examiner* — Jason S Uhlenhake
(74) *Attorney, Agent, or Firm* — HP Inc. Patent Department

(57) ABSTRACT

A print material level sensor includes a series of print material level sensing devices disposed at intervals to detect the presence of print material at successive depth zones in a container. Each print material level sensing device includes a heater to emit heat at its depth zone and a sensor to sense heat at the depth zone and to output a signal based on the heat sensed. The print material level sensor includes control circuitry to enable supply of electrical power to the heater of any one of the print material level sensing devices in its depth zone and to receive the signal from the respective sensor. The control circuitry includes a comparator to compare a value of the signal to a target value. The control circuitry disables supply of the electrical power to the heater when the value of the signal is at least equal to the target value.

20 Claims, 10 Drawing Sheets

PRINT MATERIAL LEVEL SENSING

CROSS-REFERENCE TO RELATED APPLICATION

Pursuant to 35 U.S.C. § 371, this application is a United States National Stage Application of PCT Patent Application Serial No. PCT/US2019/026107, filed on Apr. 5, 2019, the contents of which are incorporated by reference as if set forth in their entirety herein.

BACKGROUND

Printing devices eject print material to form an image or structure. The print material may be stored in a container from which it is drawn by the printing device for ejection. Over time, the level of print material in the container is reduced. A print material level sensor is useful to determine a current level of print material.

BRIEF DESCRIPTION OF DRAWINGS

Examples will now be described, by way of non-limiting example, with reference to the accompanying drawings, in which.

DETAILED DESCRIPTION

Figure 1:
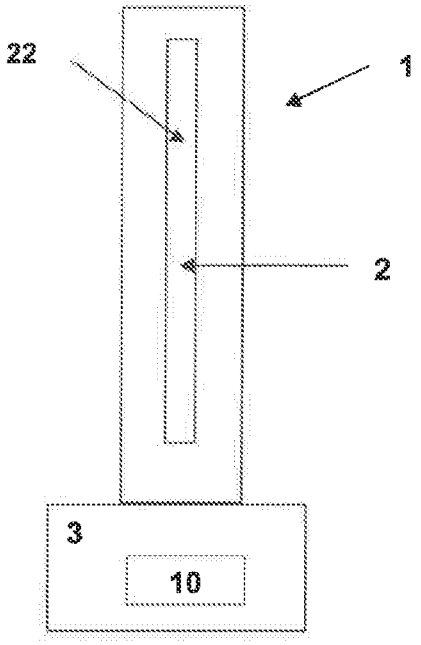
FIG. 1 shows an example print material level sensor.

FIG. 1 shows an example print material level sensor 1. The example print material level sensor 1 includes a series 2 of print material level sensing devices and control circuitry 3.

Figure 2:
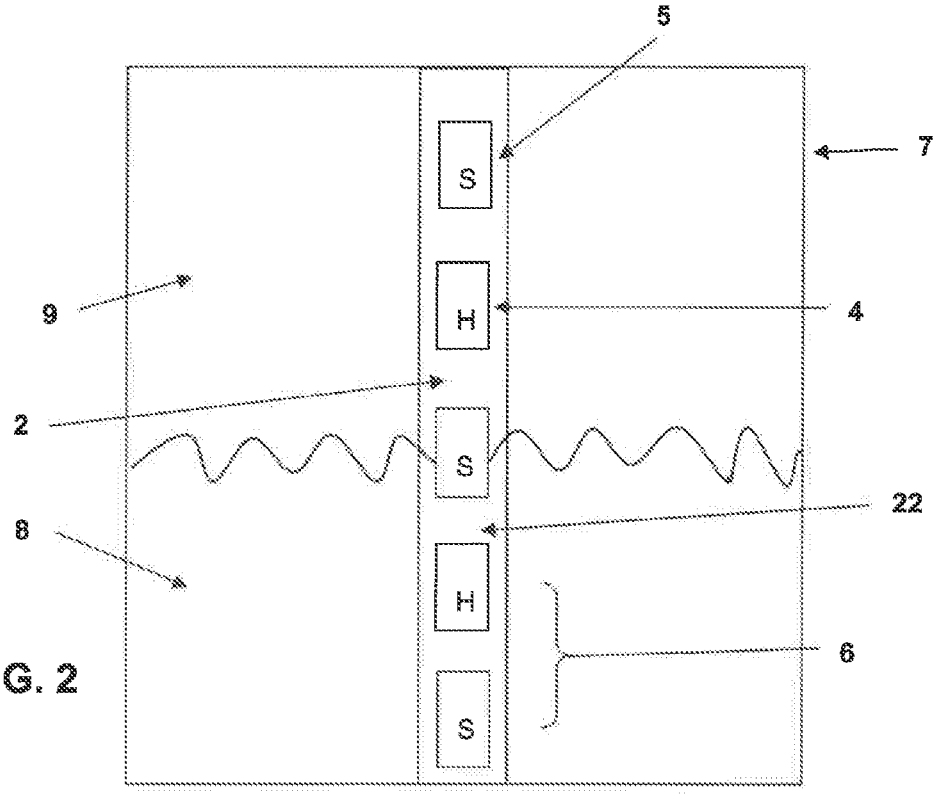
FIG. 2 shows an example series of print material level sensing devices.

FIG. 2 shows an example of part of a series 2 of print material level sensing devices. In the example of FIG. 2, a pair of a heater 4 and a sensor 5 form a print material level sensing device 6. In this way, the series of print material level sensing devices are disposed at intervals to detect presence of the print material at successive depth zones within a volume 7. The volume 7 is shown partially filled with a print material 8. The remainder of the volume may be filled with a gas, such as air 9. The extent to which the volume is filled by the print material will vary over time as print material is used in printing by a printing device. The extent to which the volume is filled will also change if the print material in the volume is replenished. Example print materials may include any of ink, for example dye based ink or pigment based ink, fixer, for example to bind ink, a primer, for example for an undercoating, a finish, for example for a coating, a fusing agent, for example for use in three-dimensional printing, and a detailing agent, for example for use in three-dimensional printing. Also, suitable print materials may for example include materials which can be titrated for use in life sciences applications.

The heater 4 of a print material level sensing device 6 emits heat at its depth zone and the sensor 5 senses heat at the depth zone to output a signal based on the heat sensed. The sensor 5 is sufficiently close to the heater 4 to sense heat when the heater is emitting heat.

The control circuitry 3 may enable supply of electrical power to a heater 4 of a print material level sensing device 6 in a depth zone and receive the signal from the sensor 5 of the print material level sensing device. The control circuitry may include a comparator 10 to compare a value of the signal to a target value. The control circuitry may stop enabling supply of the electrical power to the heater when the value of the signal becomes at least equal to the target value.

By heating a heater in a given depth zone until it is determined that the value of the signal output by the sensor in that depth zone reaches a target value, measurement to determine whether print material is present at the depth zone can be performed from a desired starting temperature. In this way a consistent measurement can be achieved at each depth zone, irrespective of whether the depth zone is closer to or further from a power source by which the heaters are powered.

Figure 3:
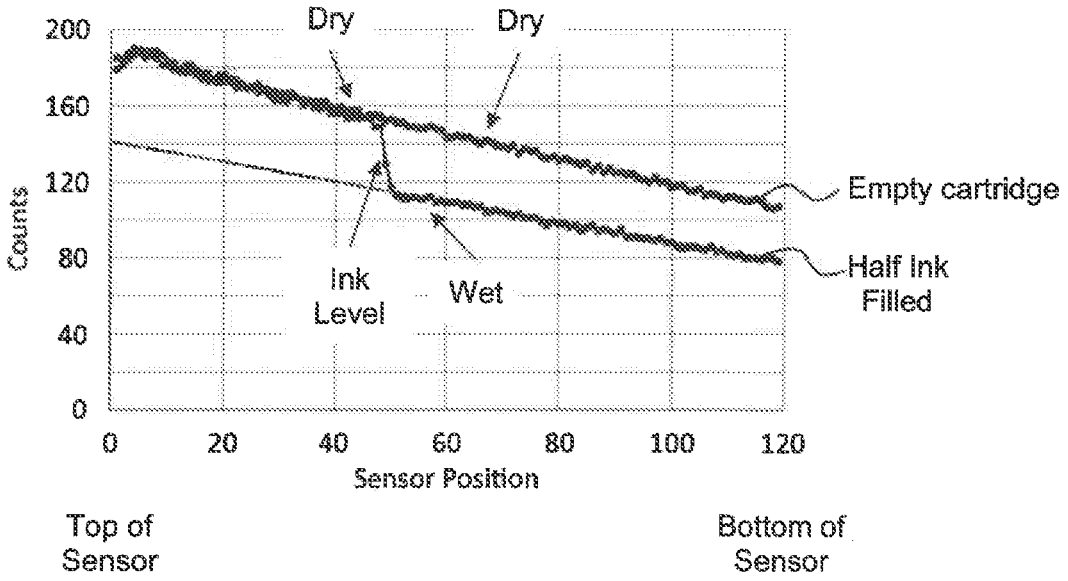
FIG. 3 shows measurement results of ink level sensing.

This is explained further with reference to FIG. 3. FIG. 3 shows measurement results from sensor 0 to sensor 120 of a series of print material level sensing devices. The data of FIG. 3 was, in contrast to the description above, obtained by heating each heater for a same predetermined amount of time. The sensors are plotted along the x axis from the sensor 0 at a top position to the sensor 120 at a bottom position. In this arrangement, the sensor 0, and its associated heater, heater 0, is closest to the power source powering the heaters. The sensor 120, and its associated heater, heater 120, is furthest from the power source powering the heaters. The y axis shows a measured value of the signal output by each sensor. In the example of FIG. 3, the measured value is obtained from the sensor by turning on its associated heater for the predetermined amount of time, turning off the heater, waiting for a fixed delay amount to expire, and then measuring the signal.

In FIG. 3, the upper line of results are when air is present around all of the sensors from sensor 0 at the top to sensor 120 at the bottom. In other words, the container is empty and no print material is present. The lower line of results are when print material, in this example ink, is present from the bottom sensor 120 up to around sensor 50. Above around sensor 50, i.e. from there up to sensor 0, air is present. The step change in the lower line of results shows the transition from print material to air. It therefore shows the level, hence the amount, of print material present in the container.

It can further be seen from FIG. 3 that the upper line of results has a slope from the sensor 0 position at the left-hand side of the graph to the sensor 120 position at the right-hand side of the graph. For the sensor 0 a measured count value of over 180 is measured whereas for the sensor 120 a measured count value of over 100 is measured. Thus, the measured value decreases as the sensor position becomes further from the top and closer to the bottom.

The lower line of results demonstrates a similar slope, both in the region at which air is present and in the region in which print material is present. The dashed line shows how the slope in the region in which print material is present would continue if print material were to be present all the way up to the sensor 0 position. It can be seen that the difference in measured value depending on which of air and print material is present at the sensor 0 position is significantly higher than the difference in measured value depending on which of air and print material is present at the sensor 120 position. The sensitivity with which the presence of air and print material can be determined is therefore greater at the sensor 0 position than at the sensor 120 position.

It has been determined by the inventors that the decrease in measured value is due to parasitic voltage drops suffered by the heaters of the print material level sensing devices as the distance from the power source increases. The narrow carrier on which the series of print material level sensing devices may be provided and the narrow wiring that transmits electrical power to the print material level sensing devices contribute to the parasitic voltage drops. As a result of the parasitic voltage drops, heaters further away from the power source receive less power in a given amount of time than heaters closer to the power source. A cause of the parasitic voltage drop in the wiring is the narrowness of the wiring and the thickness it can be fabricated to. In other words, the wiring having a width much smaller than its length. For a heater further from the power source the length of the wiring is greater than for a heater closer to the power source and hence the parasitic voltage drop is greater. The wiring may for example be in the form of metal traces, such as thin film metal traces, that transmit power from the power source to the heaters. The metal traces may be formed on the carrier by a silicon CMOS fabrication process. The metal traces may for example comprise aluminium. As an example, a metal trace may have a width of no greater than 100 μm and a length of at least 10,000 μm.

In contrast to the measurement results shown in FIG. 3, the example arrangement described above in which each heater is supplied with electrical power until the signal output by its associated sensor attains a target value enables to ensure that measurement can be performed from a same starting temperature at each print material level sensing device irrespective of the depth zone at which the print material level sensing device is located. A same sensitivity can thereby be achieved for each print material level sensing device and an undesirable reduction in signal to noise ratio (SNR) can be avoided, enabling more accurate determination of the remaining amount of print material. In an example arrangement in which the topmost sensor is closest to the power source and the bottommost sensor is furthest from the power source, the remaining amount of print material can be accurately determined as the container approaches an empty state.

Figure 4:
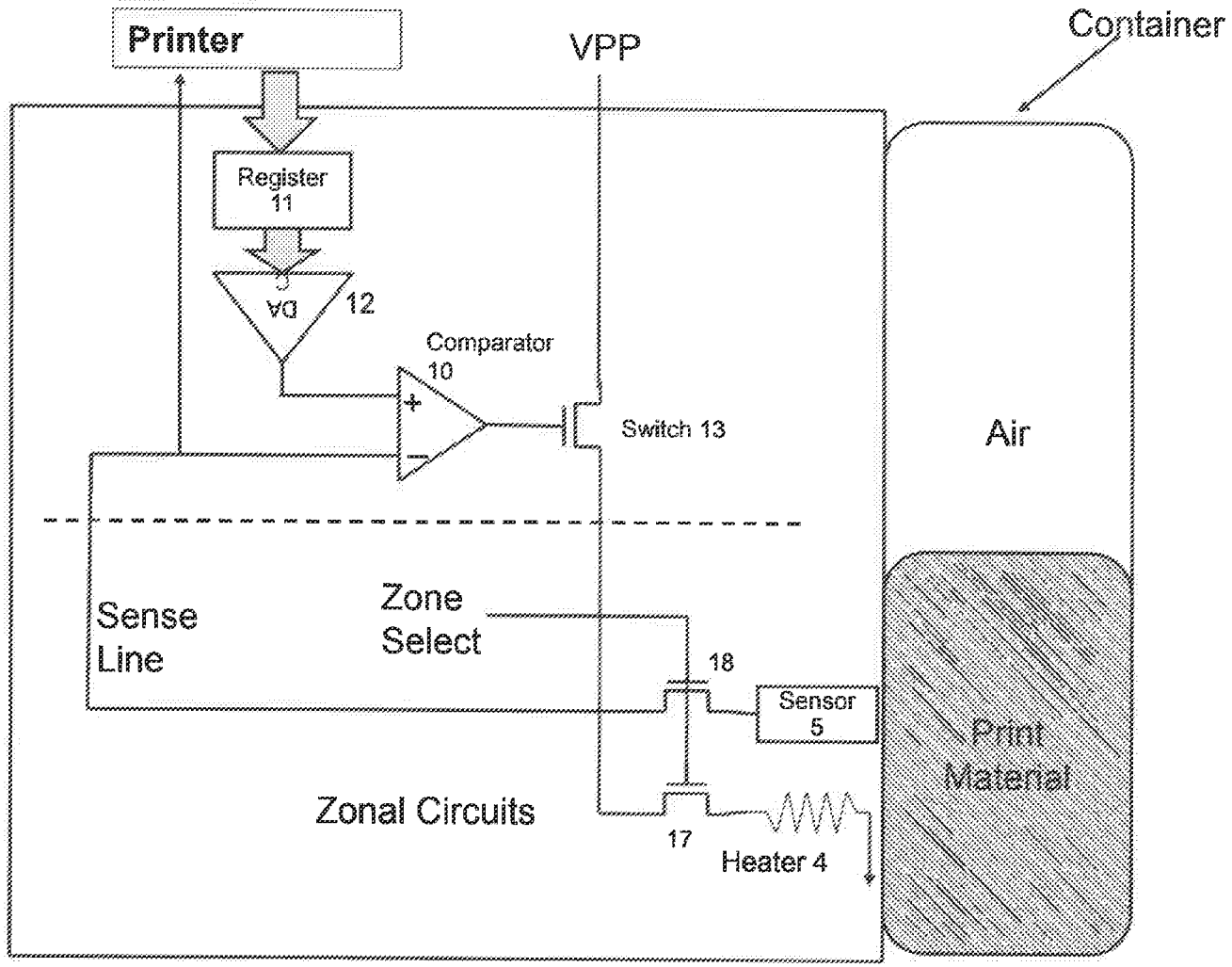
FIG. 4 shows example circuitry of an example print material level sensor.

FIG. 4 shows example circuitry of an example print material level sensor. In the example shown, the control circuitry includes a memory such as a register 11 to store the target value. The register may receive the target value from an external device such as a printer device. The register 11 may store the target value as a digital value. Provided also is a digital to analog converter (DAC) 12 to convert the target value to a first analog signal. In the example, the comparator is an analog comparator to receive the first analog signal and to receive the signal output by the sensor 5 as a second analog signal. The example further includes a switch 13 to turn on or off the supply of electrical power to a heater 4 of a print material level sensing device depending on the result of comparison by the comparator 10. The switch may be a field-effect transistor (FET). In this example, the output signal of the comparator turns on the FET to enable supply of electrical power to the heater when the second analog signal has a value, such as a voltage magnitude, lower than the first analog signal. When the value of the second analog signal becomes at least equal to the value of the first analog signal, the output signal of the comparator turns off the FET to stop the supply of electrical power to the heater 4. A measurement can then be made based on the signal output from the sensor 5. In one example, that measurement may be made after a delay time has expired from stopping enabling of the electrical power to the heater. In another example, the measurement may be made when enabling of the supply of electrical power to the heater is stopped. In a further example, measurement may be made before stopping enabling of the electrical power to the heater. In one example, the output signal of the comparator 10 may initiate measurement by a printer device. In FIG. 4, a single heater 4 and sensor 5 are depicted for simplicity. It will be appreciated that each heater 4 and sensor 5 is similarly connected to the control circuitry.

Figure 5:
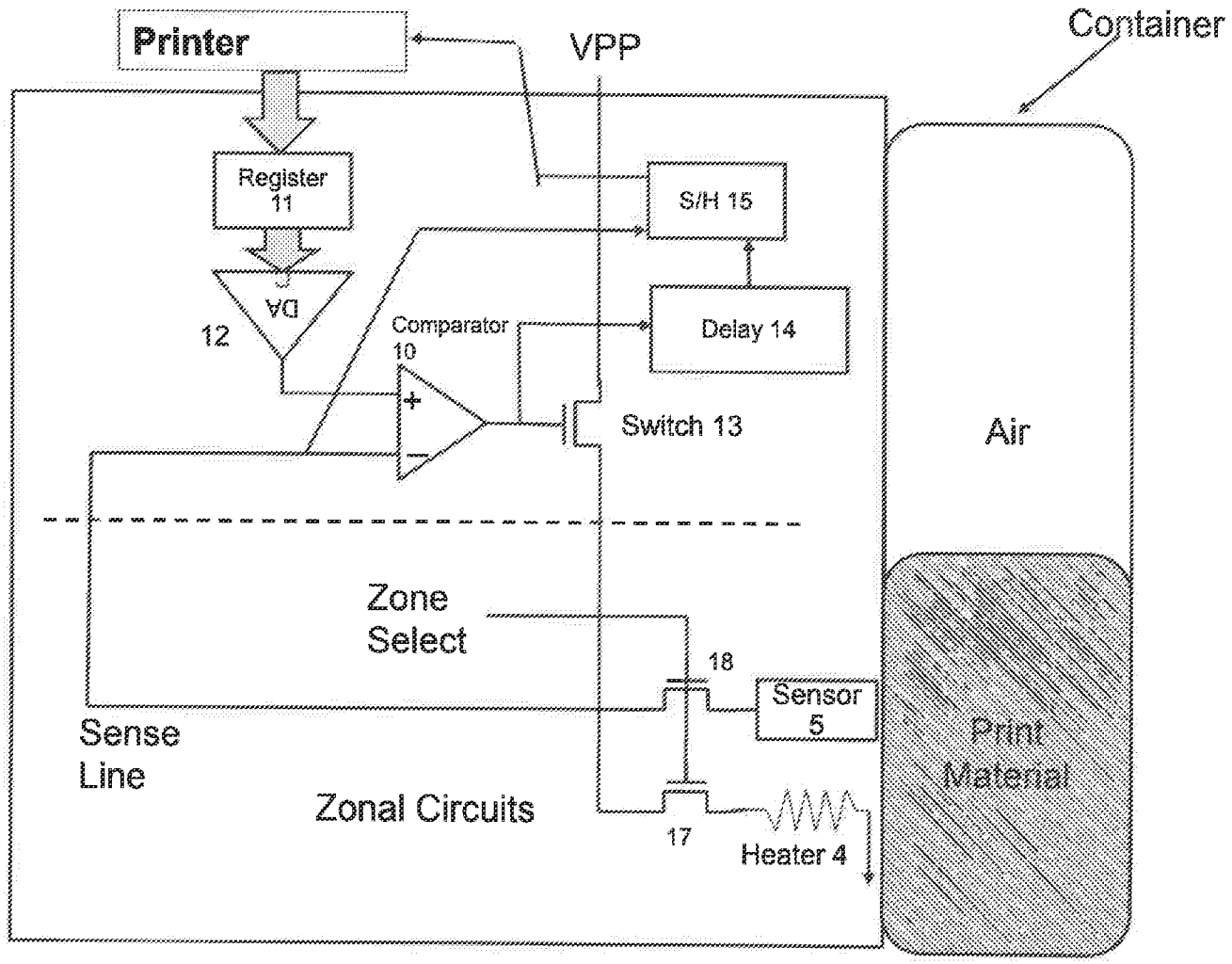
FIG. 5 shows another example circuitry of an example print material level sensor.

FIG. 5 shows another example of circuitry of an example print material level sensor. In the example of FIG. 5, the control circuitry includes a delay timer 14 to count a delay time starting when the comparator 10 determines that the value of the signal from the sensor 5 first equals or exceeds the target value and a sample and hold circuit 15 to sample the signal from the sensor 5 when the delay time has been reached. The circuit 15 may include an analog to digital converter to convert the sampled signal to a digital value. The circuit 15 may output the sampled signal or digital value to an external device such as a printing device.

Figure 6B:
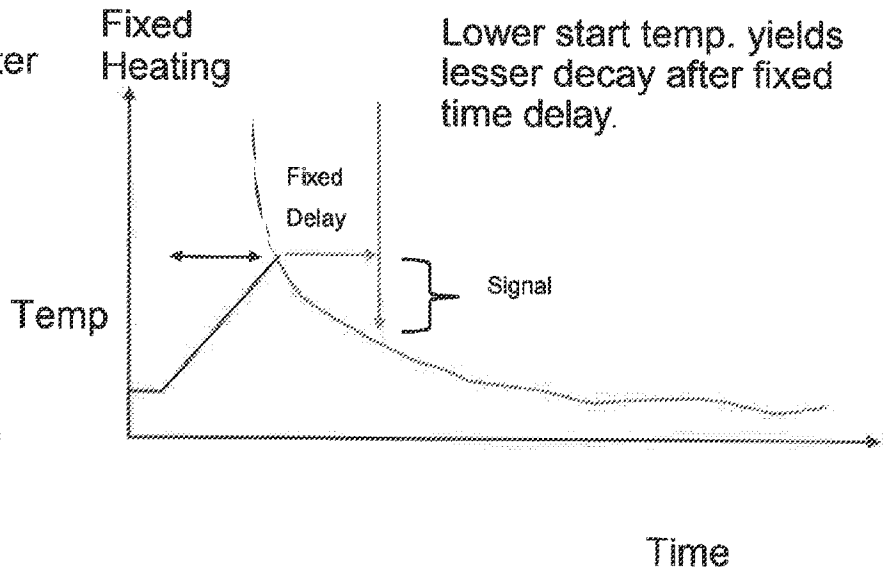
FIGS. 6A and 6B show example signal decay after heating has been stopped.
Figure 6A:
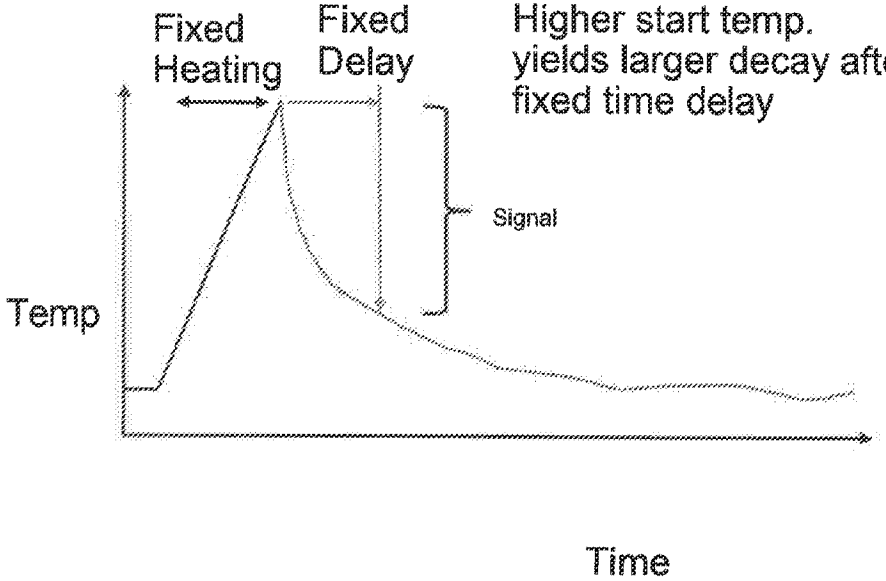

FIGS. 6A and 6B show an effect of heating a heater at a depth zone to obtain a higher starting temperature before performing measurement. If for example a measurement is made after a fixed delay time has been reached from when heating is stopped, then for a higher starting temperature a larger decay in the sensed signal may occur during the delay time. This provides more degrees of discrimination versus a depth zone that is decaying from a lower starting temperature. The circuitry therefore has a larger dynamic range to work with. The rate of decay from the starting temperature will vary depending on the heat capacity of the material present around the sensor, whereby which of print material and air is present can be determined.

Turning again to FIGS. 4 and 5, each heater 4 may have a switch 17 electrically connected to the heater to turn on or off electrical power to the heater in accordance with a zone select signal. Each sensor 5 may also have a switch 18 electrically connected to the sensor to turn on or off transmittal of the signal to the control circuitry 3 in accordance with a zone select signal. The zone select signal can be used to select a heater 4 and sensor 5, in other words a print material level sensing device 6, to perform measurement with that print material level sensing device. The switches 17, 18 enable print material level sensing devices to be selected in sequence in accordance with the zone select signal. For example, as a first print material level sensing device, a topmost print material level sensing device may be selected. Subsequent print material level sensing devices may then be selected from the topmost device towards the bottommost device. As another example, as a first print material level sensing device, a bottommost print material level sensing device may be selected. Subsequent print material level sensing devices may then be selected from the bottommost print material level sensing device towards the topmost print material level sensing device. In another example, as a first print material level sensing device a print material level sensing device at a midpoint between the topmost device and the bottommost device may be selected. Subsequent devices may then be selected in alternation on either side of that device. As a further example, a first print material level sensing device to be selected may be a print material level sensing device at the depth zone of the last detected transition between air and print material. In one example, the zone select signal may be received from an external device such as a printer. In another example, it may be generated or otherwise obtained by the control circuitry. For example the control circuitry may include a controller and the controller may for example generate or receive the zone select signal. A controller may for example be a microcontroller, CPU, processing unit or the like.

Figure 7:
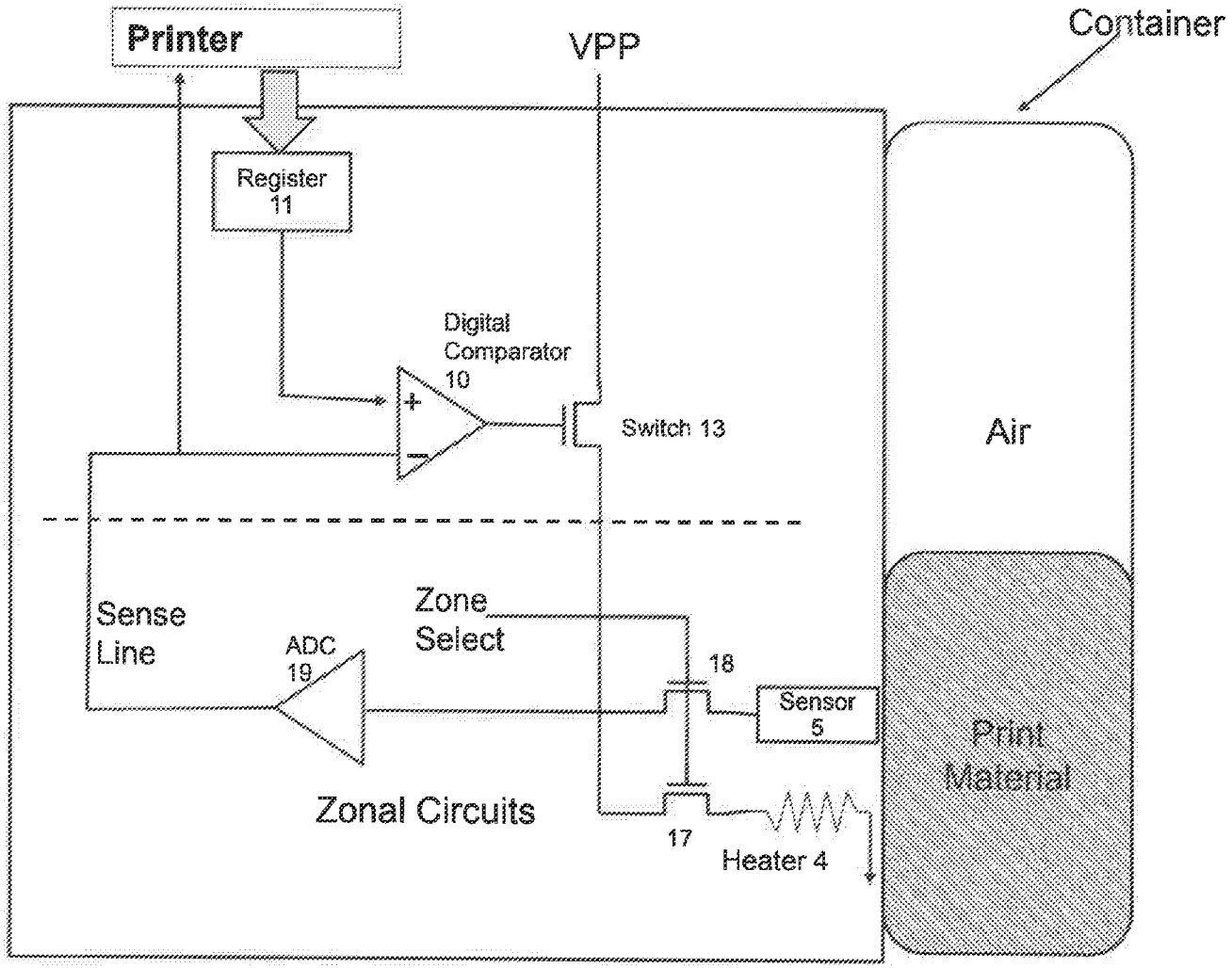
FIG. 7 shows another example of circuitry of an example print material level sensor.

FIG. 7 shows another example of circuitry of an example print material level sensor. In the example of FIG. 7, the control circuitry 3 includes an analog to digital converter (ADC) 19 to convert the signal output by the sensor 5 from an analog signal to a digital sensor value. It is also possible that the ADC 19 be provided to the sensor such that the sensor outputs a digital sensor value. A digital comparator 10 is provided to receive a target value from the register 11 and to compare the target value and the digital sensor value. A switch 13 is controlled in accordance with the output of the digital comparator 10. The switch may enable supply of electrical power to a heater 4 if the digital sensor value is less than the target value and may disable supply of electrical power to the heater 4 if the digital sensor value becomes equal to or greater than the target value. The switch may be an FET. A digital to analog converter may be provided between the comparator 10 and the FET switch 13.

Figure 8A:
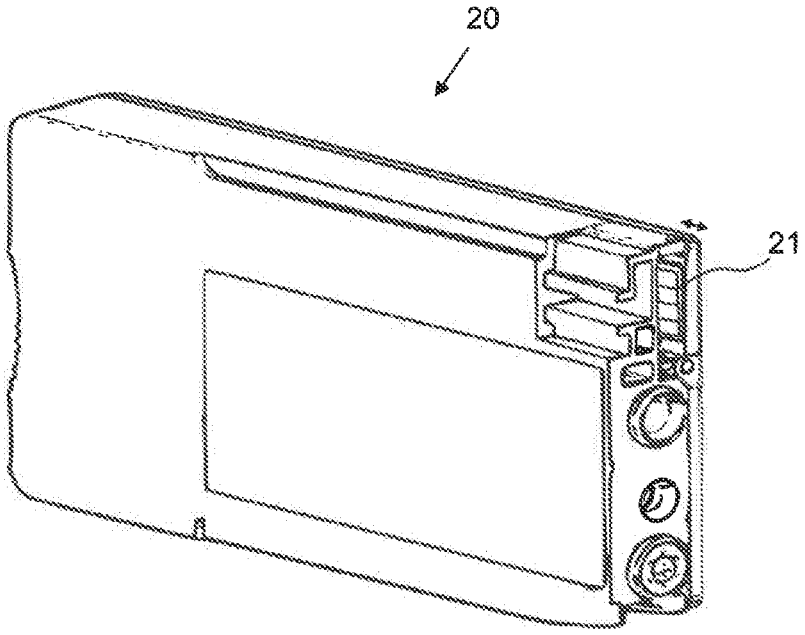
FIG. 8A shows an example print material container.
Figure 8B:
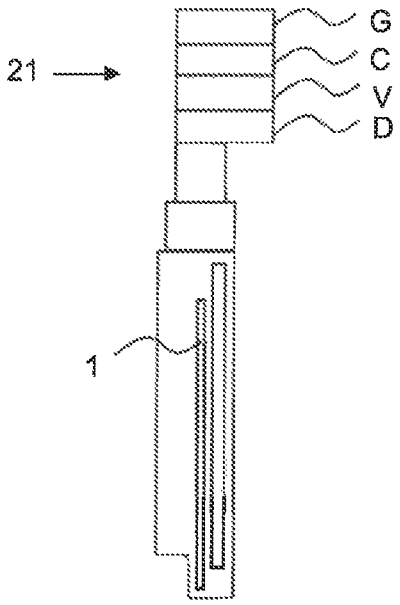
FIG. 8B shows an example print material level sensor and example electrical connection pads.

FIG. 8A shows an example print material container 20 having a print material level sensor therein. The print material container 20 includes electrical connection pads 21 to connect to an electrical connector of a printer. The electrical connection pads 21 are also connected to the print material level sensor provided within the container 20. An example of a print material level sensor 1 and electrical connection pads 21 is shown in FIG. 8B. In this example, four electrical connection pads, namely a ground connection pad G, a serial clock connection pad C, a supply voltage connection pad V and a serial data input/output pad D are provided. More or fewer pads may be provided. The electrical connection pads may form a communication bus protocol, for example an $I^2C$ data interface for communication with the printer. The electrical connection pads may enable communication of signals and electrical power between the printer and the print material level sensor.

Figure 9:
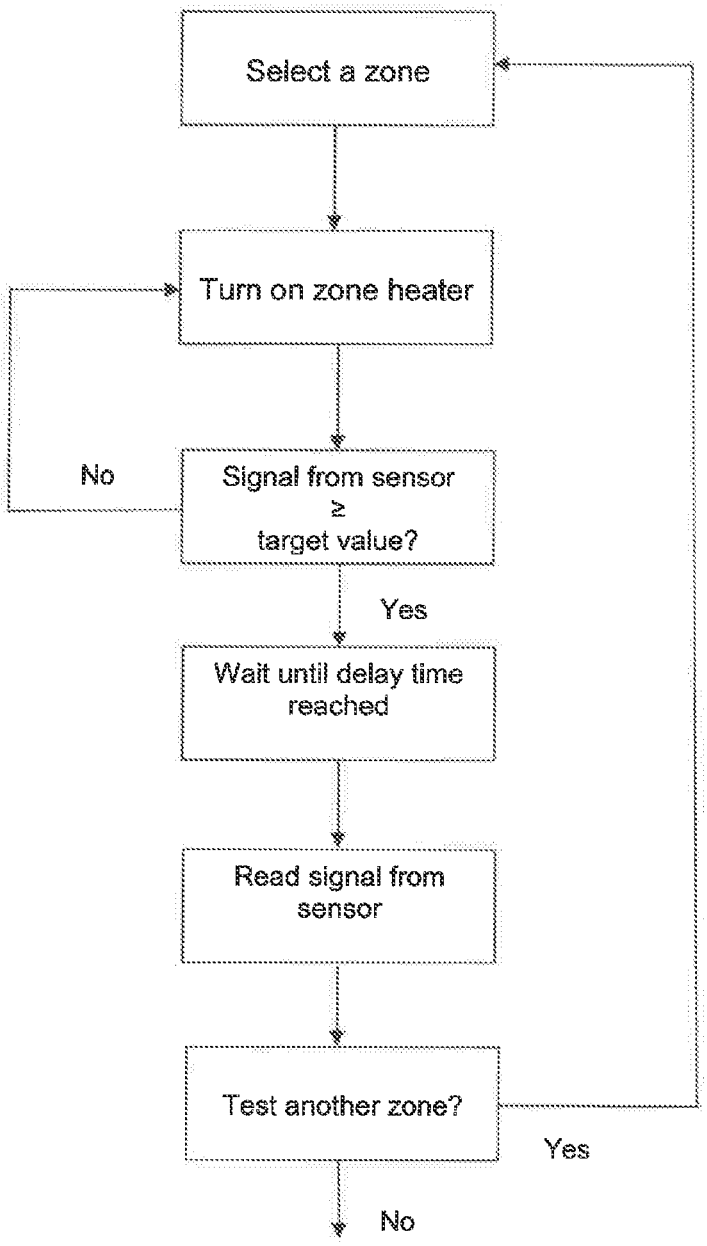
FIG. 9 shows an example of print material level sensing.

FIG. 9 shows an example of print material level sensing. A print material level sensing device 6 at a depth zone is selected, for example using the zone select signal. The zone select signal may be received from a printing device. The supply of electrical power to the heater 4 of the print material level sensing device is enabled to turn on the heater and the heater emits heat at its depth zone. A thermal sensor 5 of the print material level sensing device senses heat received at that depth zone. A value of an output signal of the thermal sensor is compared against a target value to determine whether that depth zone has been heated to a target temperature. If the value of the output signal is less than the target value, the supply of electrical power to the heater is continued so that the heater continues to emit heat. If the value of the output signal becomes at least equal to the target value, then the supply of electrical power to the heater is stopped. In the example, after the supply of electrical power to the heater has been stopped, a delay time is counted up from the stopping of the supply of the electrical power. As an example, the delay time may be at least 10 μs. As another example, the delay time may be at least 60 μs. As another example, the delay time may be in the range of 60-80 μs. As another example, the delay time may be at least 1000 μs. After the delay time has been reached, the output signal of the thermal sensor is read. In another example, the output signal of the sensor may be read when the supply of electrical power to the heater is stopped. In a further example, the output signal may be read while the heater is still turned on. As an example, the read signal may be sampled and held and converted to a digital value. It is then determined whether another depth zone is to be tested. If another depth zone is to be tested the print material level sensing device of that depth zone is selected, for example using the zone select signal. The above process is then repeated for that print material level sensing device. The process may be repeated for multiple print material level sensing devices. For example, the process may be repeated for all of the print material level sensing devices. The print material level sensing devices may be selected in a given sequence. For example by starting at the topmost device and sequentially selecting the neighbouring device until the bottommost device is selected. As another example, by starting at the bottommost device and sequentially selecting the neighbouring device until the topmost device is selected. As a further example, by starting at a device at which the transition from air to print material was last detected and by sequentially selecting neighbouring devices at increasing distance from the first selected device.

Figures 10A, 10B, 10C:
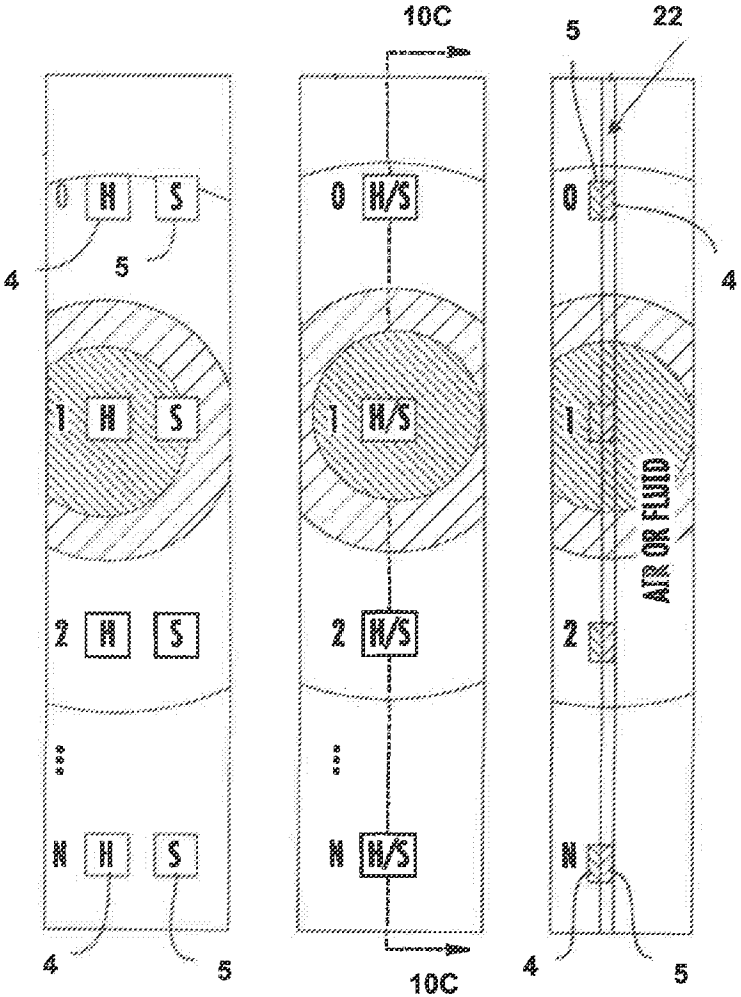
FIGS. 10A to 10C show example series of print material level sensing devices.

FIG. 2 described above shows one example of a series of print material level sensing devices. Further examples of a series of print material level sensing devices are shown in FIGS. 10A to 10C. In the example of FIG. 10A, heaters 4 and sensors 5 are arranged in pairs labelled 0, 1, 2, . . . N. Thus, the heaters and sensors are arranged in an array of side-by-side pairs. Each pair is a print material level sensing device 6.

In the example of FIG. 10B, heaters 4 and sensors 5 are arranged in an array of stacks vertically spaced. FIG. 10C is a sectional view of FIG. 10B further illustrating the stacked arrangement of the pairs of heaters 4 and sensors 5 forming the print material level sensing devices 6.

In the above described examples, a heater of a print material level sensing device may include an electrical resistor. As an example, a heater may have a heating power of at least 10 mW. As a further example, a heater may have a heating power of less than 10 W. A sensor may include a diode which has a characteristic temperature response. For example, in one example, a sensor may include a P-N junction diode. In other examples, other diodes may be employed or other thermal sensors may be employed. For example, a sensor may include a resistor such as a metal thin film resistor. The resistor may for example be located between the heater and the print material, for example by forming the resistor above the heater in a fabrication stack.

In the above described examples, a sensor of a print material level sensing device is sufficiently close to the associated heater to sense heat when the heater emits heat. For example, the sensor may be no greater than 500 μm from the heater. In a further example, the sensor may be no greater than 20 μm from the heater. As one example, the sensor may be a metal thin film resistor layer formed less than 1 μm above a heater resistor layer in a fabrication stack. In such an example, the sensor resistor layer and the heater resistor layer may be separated by a dielectric layer.

In the above described examples, there may be at least five print material level sensing devices in the print material level sensor. As a further example there may be at least ten print material level sensing devices. As a still further example, there may be at least twenty print material level sensing devices. As another example, there may be at least one hundred print material level sensing devices.

In the above described examples, the heaters and sensors may be supported on an elongated strip. A strip 22 is shown in FIGS. 1, 2 and 10C. The strip may comprise silicon. The strip may have an aspect ratio, which is a ratio of its length/width, of at least 20.

To supply electrical power received from a power source to each of the heaters 4 wiring 23 may be provided. As outlined above, the wiring 23 may be in the form of one or more metal traces, such as thin film metal traces, that transmit power from the power source to the heaters. The metal traces may be formed, for example on the strip, by a silicon CMOS fabrication process. The metal traces may for example comprise aluminium. As an example, a metal trace may have a width of no greater than 100 μm. The metal trace may have a length which is at least one hundred times greater than its width. As an example, the metal trace may have a length of at least 10,000 μm.

FIGS. 10A to 10C additionally illustrate an example of pulsing of a heater 4 of a print material level sensing device 6, and the subsequent dissipation of heat through the adjacent materials. In FIGS. 10A to 10C, the intensity of the heat declines further away from the source of the heat, i.e. the heater 4 of the print material level sensing device 6. The dissipation of heat is illustrated by the change of crosshatching in FIGS. 10A to 10C.

While apparatus, method and related aspects have been described with reference to certain examples, various modifications, changes, omissions, and substitutions can be made without departing from the spirit of the present disclosure. It is intended, therefore, that the apparatus, method and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, and "a" or "an" does not exclude a plurality.

The features of any dependent claim may be combined with the features of any of the independent claims or other dependent claims.

The invention claimed is:

1. A print material level sensor, comprising:

a series of print material level sensing devices disposed at intervals to detect a presence of a print material at successive depth zones in a container, wherein each print material level sensing device includes a heater to emit heat at its depth zone and a sensor to sense heat at the depth zone and to output a signal based on the heat sensed; and control circuitry to enable a supply of electrical power to the heater of any one of the print material level sensing devices in its respective depth zone and to receive the signal from the sensor of the print material level sensing device, the control circuitry including a comparator to compare a value of the signal to a target value, wherein the control circuitry disables the supply of the electrical power to the heater when the value of the signal is at least equal to the target value.

2. The print material level sensor of claim 1, the control circuitry further including a register to store the target value.

3. The print material level sensor of claim 1, the control circuitry further including a digital to analog converter to convert the target value from a digital value to a first analog signal, wherein the comparator is an analog comparator to receive the first analog signal and to receive the signal output by the sensor as a second analog signal.

4. The print material level sensor of claim 1, the control circuitry further including an analog to digital converter to convert the signal output by the sensor from an analog signal to a digital sensor value, wherein the comparator is a digital comparator to compare the target value to the digital sensor value.

5. The print material level sensor of claim 1, the control circuitry further including a switch to stop supply of the electrical power to the heater when an output signal of the comparator indicates that the value of the signal output by the sensor is at least equal to the target value.

6. The print material level sensor of claim 5, wherein the switch is a field-effect transistor (FET).

7. The print material level sensor of claim 1, wherein the heater of each print material level sensing device has a switch electrically connected to the heater to turn on or off electrical power to the heater in accordance with a zone select signal.

8. The print material level sensor of claim 1, wherein the sensor of each print material level sensing device has a switch electrically connected to the sensor to turn on or off transmittal of the signal to the control circuitry in accordance with a zone select signal.

9. The print material level sensor of claim 1, wherein the control circuitry samples the signal from the sensor after disabling the supply of the electrical power to the heater.

10. The print material level sensor of claim 9, wherein the control circuitry samples the signal from the sensor after a delay time has expired from disabling the supply of the electrical power to the heater.

11. The print material level sensor of any of claim 1, the control circuitry including a delay timer to count a delay time starting when the comparator determines that the value of the signal first equals or exceeds the target value and a sample and hold circuit to sample the signal when the delay time has been reached.

12. The print material level sensor of claim 1, wherein the control circuitry enables the supply of electrical power to the heater of each print material level sensing device in a sequence.

13. The print material level sensor of claim 1, wherein the series of print material level sensing devices is provided on an elongated strip having an aspect ratio of at least 20.

14. A print material container, comprising:

a chamber to hold a print material;

a series of print material level sensing devices disposed at intervals to detect a presence of the print material at successive depth zones in the chamber, wherein each print material level sensing device includes a heater to emit heat at its depth zone and a sensor to sense heat at the depth zone and to output a signal based on the heat sensed; and control circuitry to enable a supply of electrical power to the heater of any one of the print material level sensing devices in its respective depth zone and to receive the signal from the sensor of the print material level sensing device, the control circuitry including a comparator to compare a value of the signal to a target value, wherein the control circuitry disables the supply of the electrical power to the heater when the value of the signal is at least equal to the target value.

15. The print material container of claim 14, the control circuitry further including a switch to disable the supply of the electrical power to the heater when an output signal of the comparator indicates that the value of the signal output by the sensor is at least equal to the target value.

16. The print material container of claim 14, wherein the control circuitry enables the supply of electrical power to the heater of each print material level sensing device in a sequence.

17. The print material container of claim 14, wherein the heater of each print material level sensing device has a switch electrically connected to the heater to turn on or off electrical power to the heater in accordance with a zone select signal.

18. The print material container of claim 14, wherein the sensor of each print material level sensing device has a switch electrically connected to the sensor to turn on or off transmittal of the signal to the control circuitry in accordance with a zone select signal.

19. The print material container of claim 14, wherein the control circuitry samples the signal from the sensor after disabling the supply of the electrical power to the heater.

20. A method, comprising:

for each of a series of print material level sensing devices provided at successive depth zones of a chamber holding a print material;

supplying electrical power to a heater of the print material level sensing device to emit heat at the depth zone of the print material level sensing device;

sensing heat received by a thermal sensor of the print material level sensing device at the depth zone;

comparing a signal from the thermal sensor to a target value to determine whether the depth zone has been heated to a target temperature;

disabling the supply of the electrical power to the heater when it is determined that the depth zone has been heated to at least the target temperature;

counting a delay time from the disabling of the supply of the electrical power; and reading the signal from the thermal sensor after the delay time has been reached to determine whether the print material is present at the depth zone.

* * * * *